US010801808B2

(12) United States Patent
Rivera

(10) Patent No.: US 10,801,808 B2
(45) Date of Patent: Oct. 13, 2020

(54) WEAPONIZED DEFENSIVE AX TOOL

(71) Applicant: John Vincent Rivera, Vero Beach, FL (US)

(72) Inventor: John Vincent Rivera, Vero Beach, FL (US)

( * ) Notice: Subject to any disclaimer, the term of this patent is extended or adjusted under 35 U.S.C. 154(b) by 0 days.

(21) Appl. No.: 16/048,875

(22) Filed: Jul. 30, 2018

(65) Prior Publication Data

US 2020/0049451 A1 Feb. 13, 2020

Related U.S. Application Data

(63) Continuation of application No. 15/437,023, filed on Feb. 20, 2017, now Pat. No. 10,036,610.

(60) Provisional application No. 62/297,843, filed on Feb. 20, 2016.

(51) Int. Cl.

| | |
|---|---|
| ***F41C 27/16*** | (2006.01) |
| ***F41H 13/00*** | (2006.01) |
| ***F41H 9/10*** | (2006.01) |
| ***F41G 1/35*** | (2006.01) |
| ***F41C 9/02*** | (2006.01) |
| ***F41B 13/00*** | (2006.01) |
| *F41C 9/04* | (2006.01) |

(52) U.S. Cl.

CPC ..... *F41C 27/16* (2013.01); *F41B 13/00* (2013.01); *F41C 9/02* (2013.01); *F41G 1/35* (2013.01); *F41H 9/10* (2013.01); *F41H 13/0018* (2013.01); *F41C 9/04* (2013.01)

(58) Field of Classification Search

CPC ..... F41C 27/18; F41C 27/16; F41C 27/20; F41G 1/35; F41H 9/10; F41H 13/0018; F41H 13/0012; F41H 13/0031

USPC ..... 42/69.01, 1.08, 1.09, 1.11, 1.16, 52, 53, 42/106

See application file for complete search history.

(56) References Cited

U.S. PATENT DOCUMENTS

| | | | | | |
|---|---|---|---|---|---|
| 1,298,920 | A | * | 4/1919 | Farago | F41C 27/16 42/53 |
| 1,330,062 | A | * | 2/1920 | Dluzniewski | F41C 27/16 42/53 |
| 1,404,034 | A | * | 1/1922 | Kurczab | F41C 27/16 42/53 |
| 1,478,568 | A | * | 12/1923 | Kaperzenski | F41C 27/16 42/53 |
| 2,050,861 | A | * | 8/1936 | Rolston | F41H 9/10 42/1.08 |
| 2,805,507 | A | * | 9/1957 | Buquor | F41C 27/16 42/53 |
| 4,058,237 | A | | 11/1977 | Luke | |
| 4,061,249 | A | | 12/1977 | Smith | |

(Continued)

*Primary Examiner* — John Cooper

(74) *Attorney, Agent, or Firm* — Wolter Van Dyke Davis, PLLC; John L. DeAngelis

(57) ABSTRACT

A tool. A firearm, a blade and an ancillary device are disposed within or on the tool. The firearm comprises a barrel through which a bullet passes to exit the firearm, a firing pin moveable to a firing position by operation of a firing pin control, a firing pin lock retaining the firing pin in the firing position when in the locked position, a biasing member for applying a force to the firing pin with the firing pin restrained against the force by the locked position of the firing pin lock. A trigger releases the firing pin lock from the locked position, such that the force causes the firing pin to strike the charge proximate the bullet. The bullet then exits the barrel.

20 Claims, 15 Drawing Sheets

(56) References Cited

U.S. PATENT DOCUMENTS

| | | | | |
|---|---|---|---|---|
| 4,241,850 | A | 12/1980 | Speer | |
| 4,550,861 | A | 11/1985 | Fay, Sr. | |
| 5,217,143 | A | 6/1993 | Aitken | |
| 5,358,144 | A | 10/1994 | Mock | |
| 5,516,005 | A | 5/1996 | Moseley | |
| 5,815,467 | A | 9/1998 | Deering | |
| 5,924,601 | A | 7/1999 | Chen | |
| 6,135,321 | A | 10/2000 | Hippensteel | |
| 6,540,106 | B2 | 4/2003 | Gerstner | |
| 6,540,107 | B1 | 4/2003 | Admony | |
| D530,386 | S * | 10/2006 | Betts | F41C 27/16 D22/101 |
| 7,905,042 | B2 * | 3/2011 | Carmel | F41A 19/10 42/1.09 |
| 8,196,328 | B2 * | 6/2012 | Simpkins | B25F 1/04 42/114 |
| 9,347,749 | B2 | 5/2016 | Olah | |
| 2016/0153742 | A1 * | 6/2016 | Copeland | F41C 27/04 42/72 |

* cited by examiner

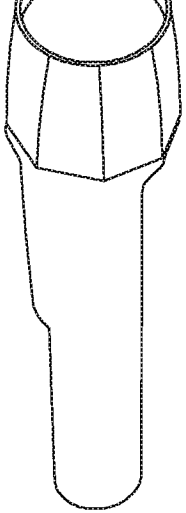
FIG. 1A
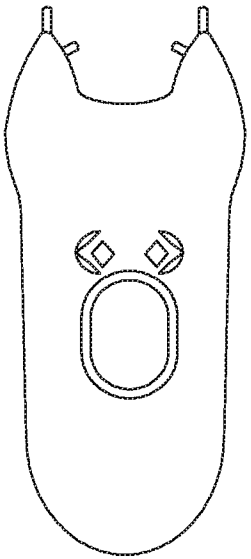
FIG. 1B
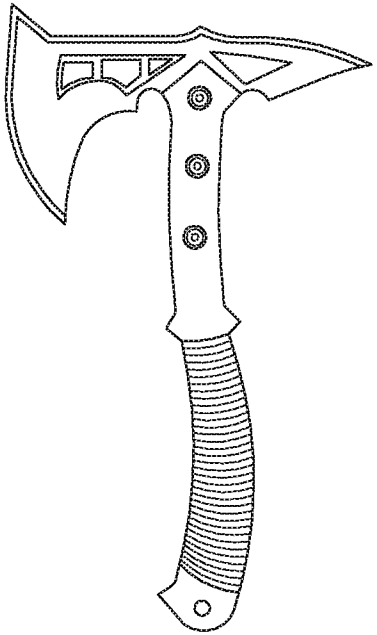
FIG. 1C
FIG. 1D
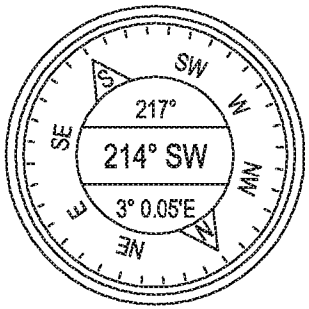
FIG. 1E

WEAPONIZED DEFENSIVE AX TOOL

CROSS REFERENCE TO RELATED APPLICATIONS

This patent application is a continuation of U.S. patent application Ser. No. 15/437,023, filed on Feb. 20, 2017 and entitled "WEAPONIZED DEFENSIVE AX TOOL", which claims the benefit of U.S. provisional patent application filed on Feb. 20, 2016 and assigned Application No. 62/297,843, both of which are incorporated herein in their entirety.

FIELD OF THE INVENTION

The present invention relates generally to a defensive weapon, and more particularly to a weaponized defensive ax tool.

BACKGROUND OF THE INVENTION

Many people spend time in the great outdoors; woods, forests, jungles, mountains, and the like. Often those venues are in remote locations inhabited by an assortment of potentially dangerous wildlife—snakes, bears, large cats, wild boars, alligators, not to mention potentially rabid smaller animal. As well, people who venture into those areas often seek to lighten the amount of gear that they carry: and in other instances, a fall or other mishap may separate them from a well-equipped back pack or other form of carrying or stowage—type satchel.

For that reason, a multi-purpose, light weight, back-up utility device, which allows for activities like chopping away branches or brush, or creating firewood, while at the same time, combining an assortment of varied weapons to be selected depending on the nature or degree of a perceived threat may prove a welcome addition to their foray into those environments.

BRIEF DESCRIPTION OF THE FIGURES

The skilled artisan will understand that the drawings, as described below, are for illustration purposes only. The drawings are not intended to limit the scope of the present invention in any way. Several of the Figures are block diagrams that depict the components necessary for the operation of the invention.

FIGS. 1A-1E illustrate various individual tools that have been engineered to work together and incorporated into an ax tool of the present invention.

FIGS. 18A and 18B are side views of embodiments of the tool incorporating external tool compartments and 19A and 19B are side views of embodiments of the tool incorporating firearm compartments.

DETAILED DESCRIPTION OF THE INVENTION

Before describing in detail the particular methods and apparatuses related to a multi-purpose weapon and tool, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the inventions.

The presented embodiments are not intended to define limits as to the structures, elements or methods of the inventions, but only to provide exemplary constructions. The embodiments are permissive rather than mandatory and illustrative rather than exhaustive.

The present invention addresses the circumstances described above in the BACKGROUND section by allowing the user to be prepared for an array of sudden or unanticipated events and enhances the user's chances of survival, or avoidance of harm or death.

The present invention flows from the use of a basic ax type structure. The entire ax structure has been re-engineered, expanded and adapted so that in one embodiment it provides a self-contained pepper spray-type deterrent, a shocking device, (commercially known as a Taser, which is a registered trademark of Axon Enterprise, Inc. of Scottsdale, Ariz.), a double-sided ax blade, and multi barreled firearm with a laser-guided aiming beam, as well as a flash light. The resulting tool or weapon is a non-obvious extension of a prior art ax.

Yet another embodiment also includes a compass, a tool compartment, and hammering capability. Several of these components (referred to as ancillary devices) are depicted separately in FIG. 1A (pepper spray container), 1B (shocking device), 1C (ax), 1D (light), and 1E (compass).

Figure 2:
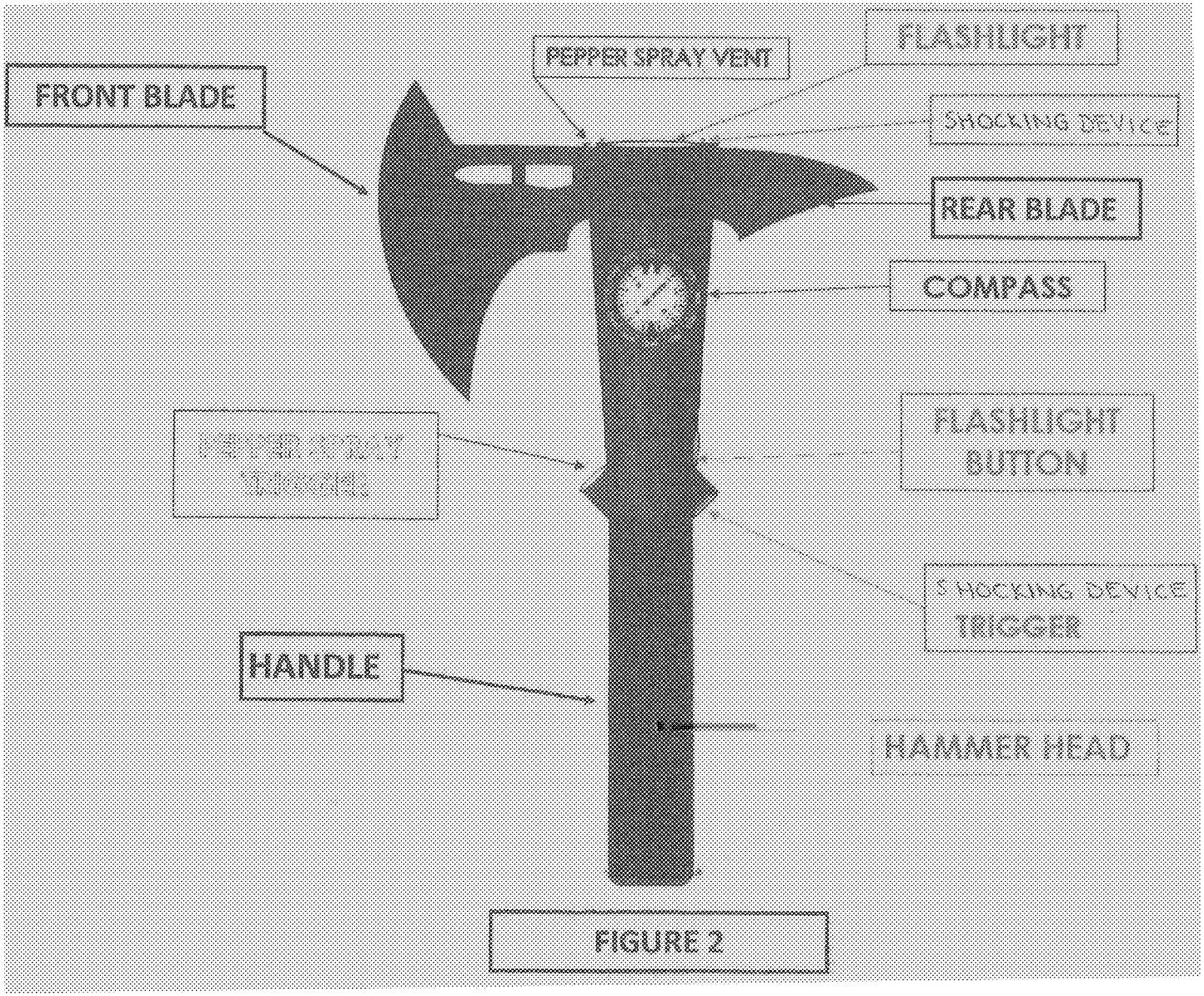
FIG. 2 illustrates a single sided view identifying the outside component parts of the weaponized ax tool.

FIG. 2 illustrates one embodiment of a tool or ax and its attached or embedded components. Accordingly, to this embodiment, the ax comprises a double-sided ax blade and a compass on one surface and a tool compartment on an opposing surface (not visible in FIG. 2). A butt end of the ax handle serves as a hammer head and thus can be used as a hammering tool. A pepper spray trigger, along the ax handle, ejects pepper spray from a pepper spray vent located at the ax-end (top) of the handle. Shocking device prongs, also located at the ax-end (top), are energized by depressing a shocking device trigger located along the ax handle on the opposite side of the pepper spray trigger. A flashlight beam is activated by depressing the flashlight button. The various buttons are disposed along the handle at convenient locations within easy reach when the user grasps the ax handle.

Figure 3:
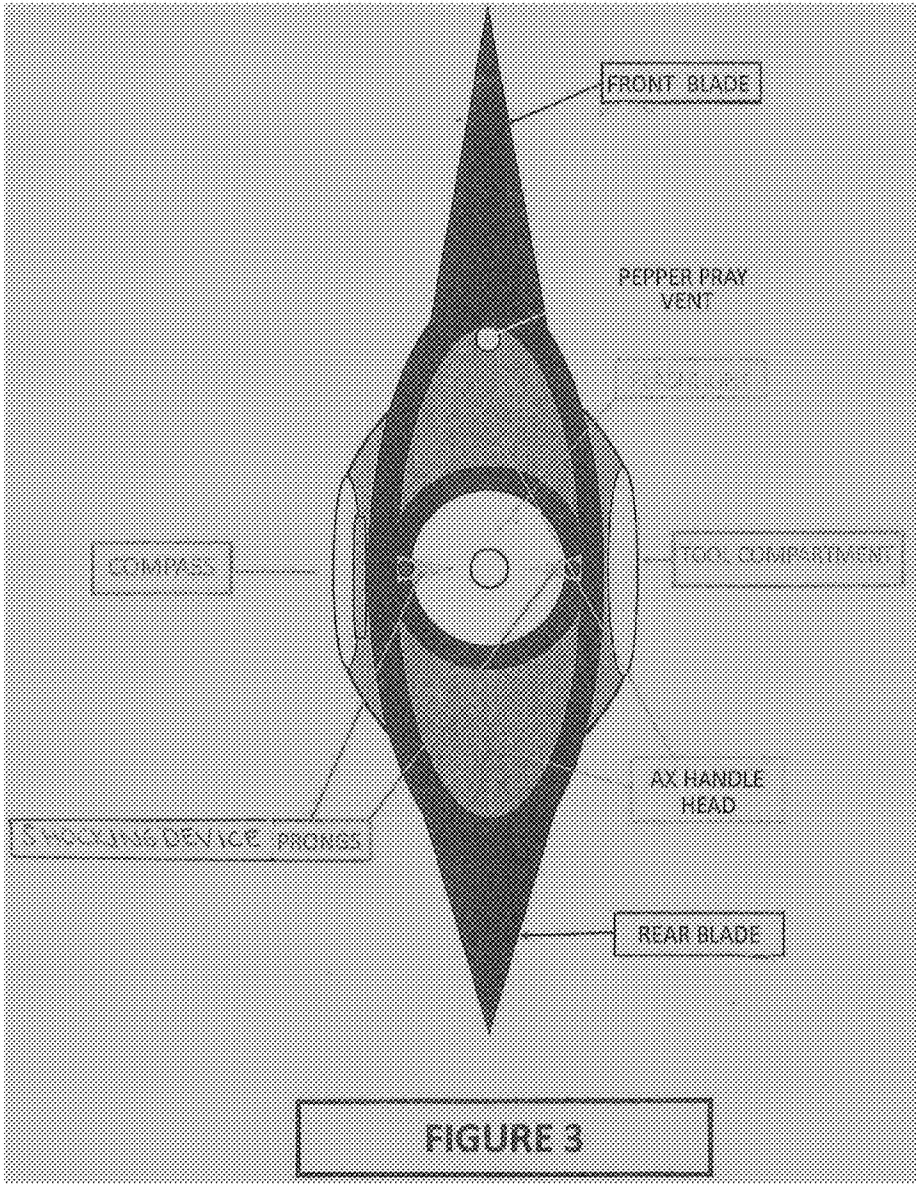
FIGS. 3 and 4 are respective top and side views of a tool constructed according to the teachings of the present invention.

FIG. 3 is a top view of the ax tool head showing the location of the shocking device prongs, the source of the flashlight beam and pepper spray vent. A location of a tool compartment is also indicated generally.

Figure 4:
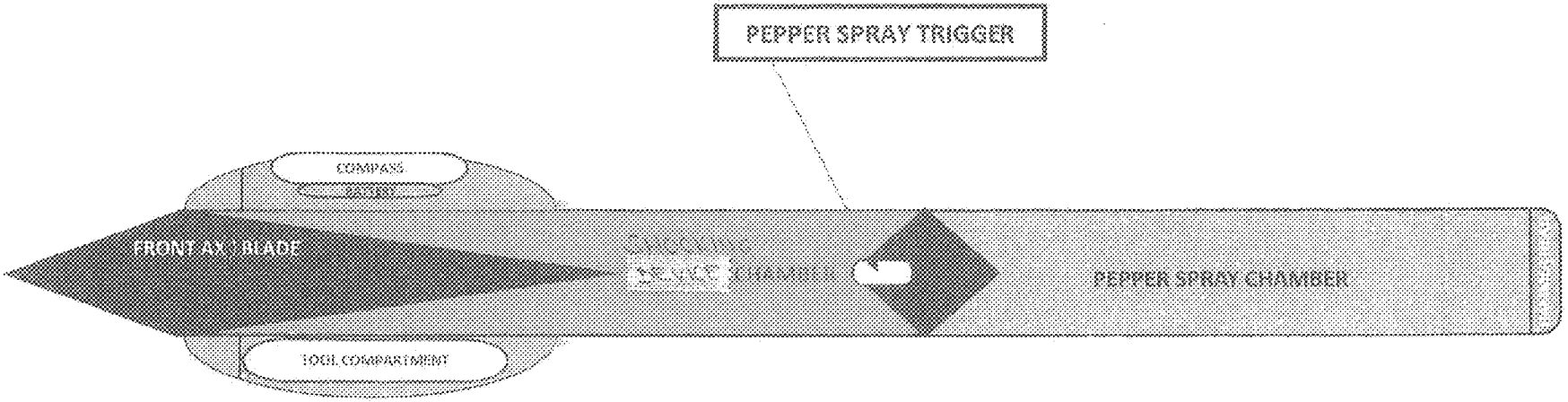

FIG. 4 is a side view of the ax tool, showing in particular, the pepper spray trigger and the pepper spray chamber.

One embodiment of the ax includes a firearm component that stores and can fire up to two 45 caliber bullets, shotgun shells as well as other calibers of ammunition.

Figure 5:
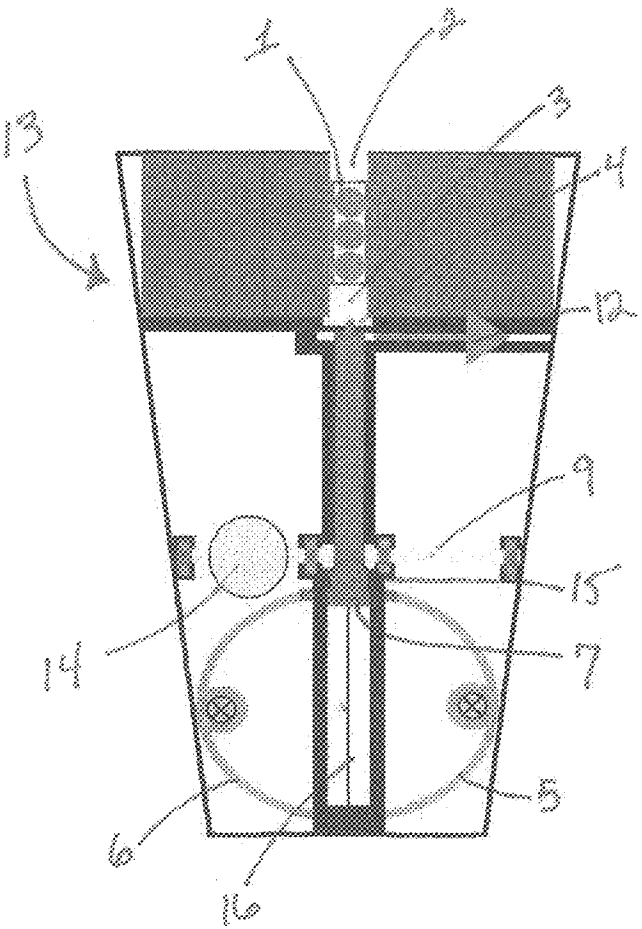
FIG. 5 is a cut-away top view of the internal firearm component of the tool.

The firearm compartment shown in a cut-away top view of FIG. 5, is illustrated generally and in more detail in FIGS. 6 through 9.

Figure 8:
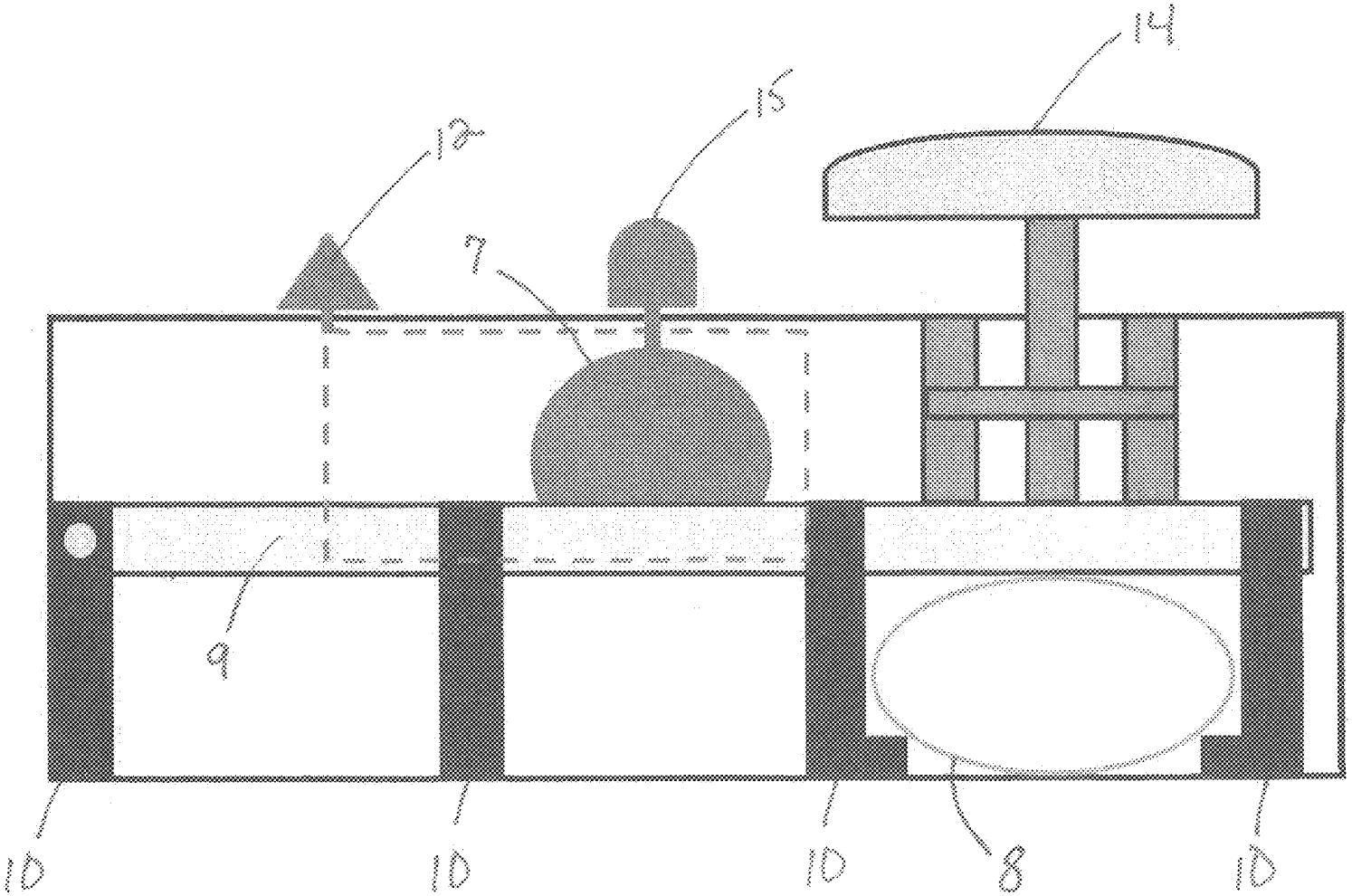
FIGS. 8 and 9 are cut-away views of the internal components of the firearm component.
Figure 9:
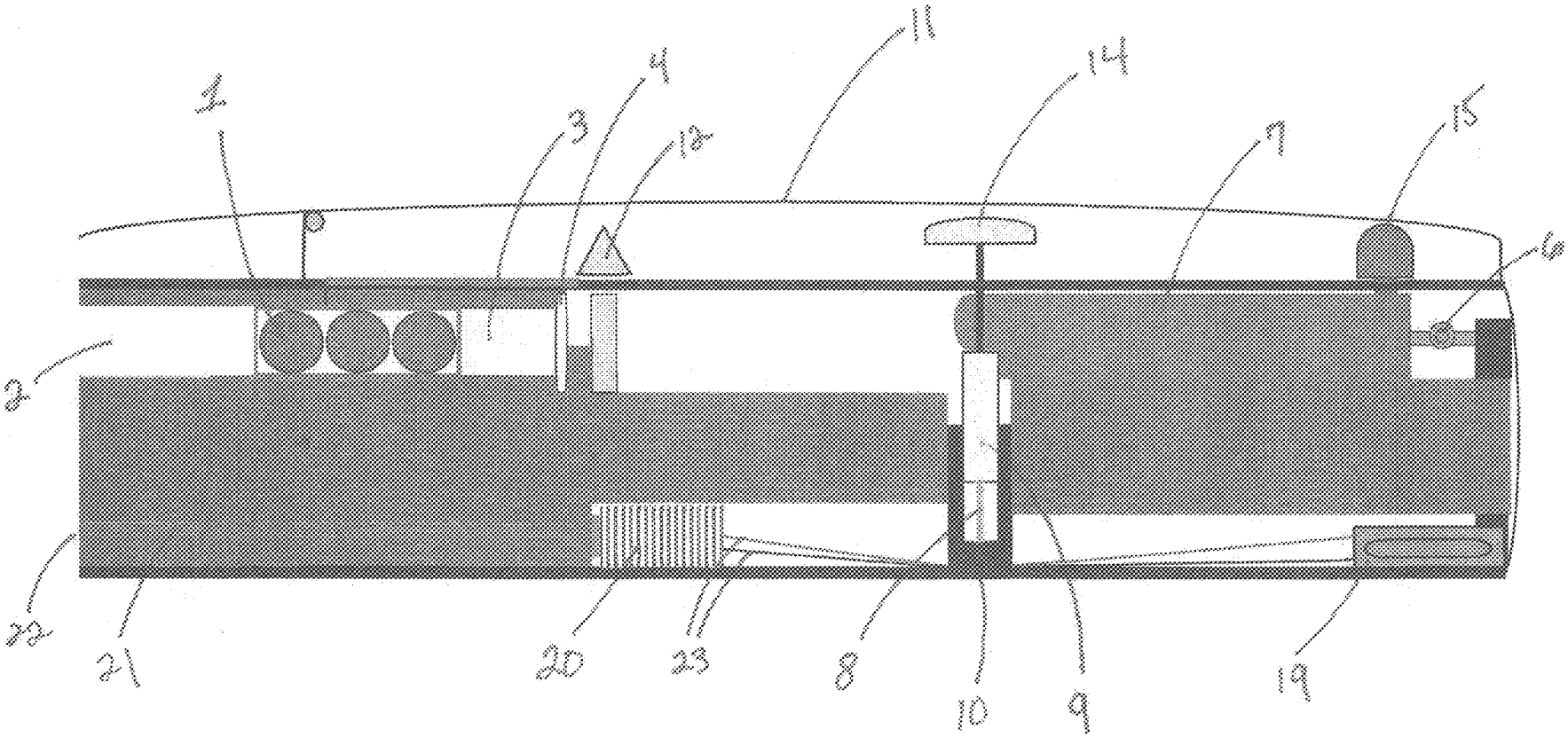

Referring to the FIG. 5 cut-away top view, the FIG. 8 cut-away front view and the FIG. 9 cut-away side view, the weapon components are depicted in greater detail.

Turning to FIG. 5, the firearm component, when fired by a user, ejects a bullet 1 from a barrel 2. The bullet 1 is encased within a shell 3. The rear surface of the shell 3 comprises a charge (primer) 4. In a "ready to fire" condition, the firearm coils 5 and 6 are in a biased or cocked condition, applying a force to the rear surface of the firing pin 7.

Turning to FIG. 8, a spring or coil 8 urges a firing pin lock bar 9 upwardly within a u-shaped support member 10 to retain the firing pin 7 in the "ready to fire" configuration against the force exerted on the firing pin 7 by the coils 5 and 6 illustrated in FIG. 5. The coils 5 and 6 generate sufficient force to drive the firing pin 7 forward to strike the charge 4 to eject the bullet 1 from the barrel 2.

Depressing the trigger 14 releases the firing pin 7 (see in particular FIG. 9), driving the firing pin forward to strike the charge 4 to eject the bullet 1 from the barrel 2. The features and functionality of the firing pin safety handle 12, which must be positioned to expose the charge 4, is described below.

FIG. 9 depicts the cut-away side view of the various components of the firearm component including: the bullet 1, the barrel 2, the shell 3, the primer (charge) 4, the safety cover 11, the trigger 14, the firing pin 7, the firing pin slide 15, the firing pin lock bar 9, the firing pin coil 6, the firing pin lock bar coil 8, the U-shaped support member 10.

One embodiment of the invention further comprises a laser 20, powered by a battery 19. A laser beam 21 is emitted through an opening 22 in the body of the firearm component 13 as depicted in FIG. 5.

The user's use of the laser beam provides more accurate aiming at a target. Conductors 23 supply power from the battery 19 to the laser 20. In one embodiment, the laser turns on when the user opens the safety cover 11 of FIG. 9.

To place the firearm component 13 in a firing-ready condition a firing pin slider 15 is moved within a respective groove 16 in a direction away from the barrel 2. This action biases the coils 5 and 6 and causes the spring or coil 8 to force the firing pin lock bar 9 upwardly to lock the firing pin 7 in the firing-ready condition. As best illustrated in FIGS. 8 and 9, the firing pin lock bar 9 prevents the firing pin 7 from moving forward until the trigger 14 is depressed.

Figure 7:
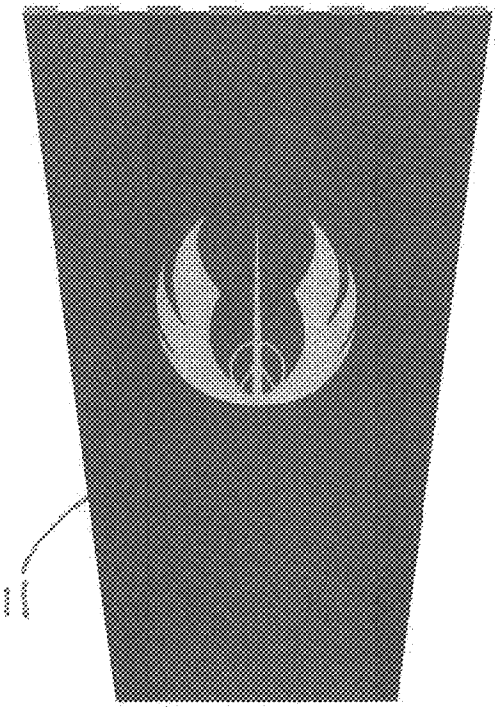
FIGS. 6 and 7 are views of the firearm operations platform and outer cover.
Figure 6:
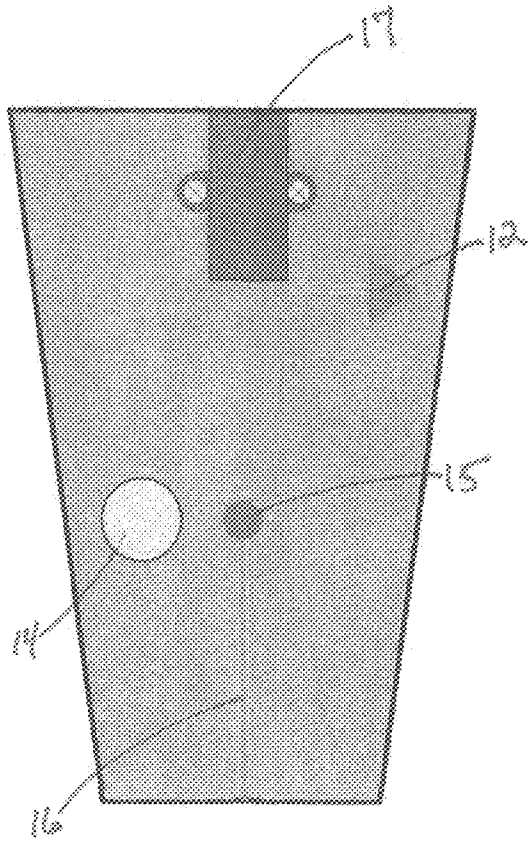

To fire the firearm, a safety cover 11 (FIG. 7) is lifted revealing the operational components; see FIG. 6. The trigger 14, the primer safety handle 12, the firing pin slider 15 and its groove 16, and the bullet loading zone cover 17 are shown in FIG. 7.

To provide additional protection against an accidental firing, the primer safety handle 12 (see FIG. 9) is typically maintained in position against and covering the charge 4. Applying a force against the primer safety handle 12 causes the handle to move toward an edge of the weapon 13 as depicted in FIG. 5. This action exposes the primer charge 4.

Then depressing the trigger 14 lowers the firing pin lock bar 9 within the U-shaped support member 10 releasing the coils 5 and 6 from their biased condition, driving the firing pin 7 forward to strike the charge 4 and ejecting the bullets 1 from the barrel 2.

The firearm component is further described in the co-pending and co-owned patent application filed on Feb. 16, 2017 and assigned application Ser. No. 15/434,366. The contents of that application are incorporated herein by reference.

Figure 10:
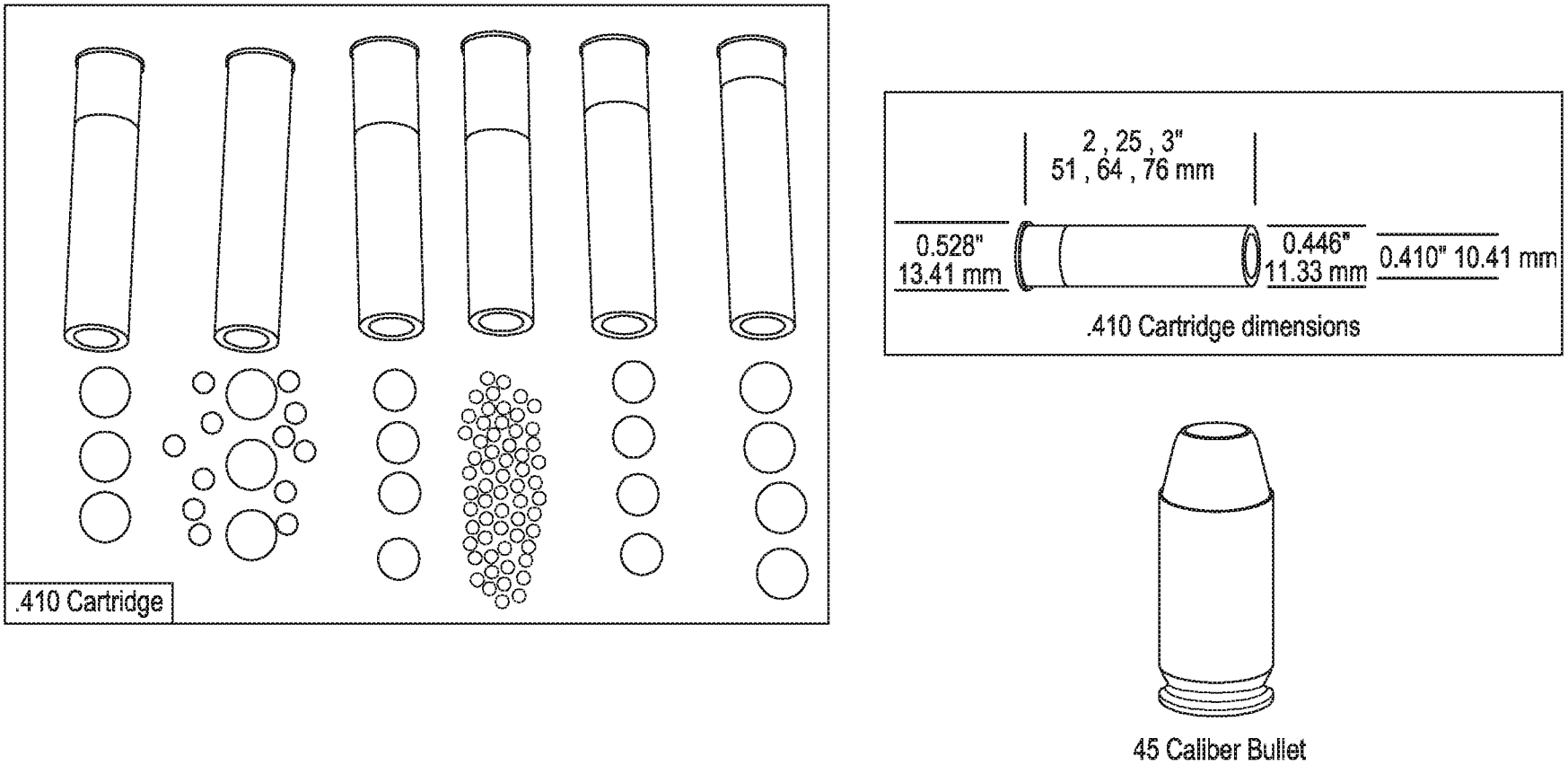
FIG. 10 illustrates the various bullets that can be used with the tool of the present invention.

FIG. 10 depicts various types of the .410 shotgun shell ammunition. This device can also fire .45 colt ammunition, .45 Schofield ammunition. Any ammunition with a 13.41 mm primer and 11.33 mm shell casing can be loaded into the firearm component through the firearm loading zone cover 17. Those skilled in the art recognize that the firearm component 13 can be scaled up or down to accommodate differently sized ammunition.

Figure 11:
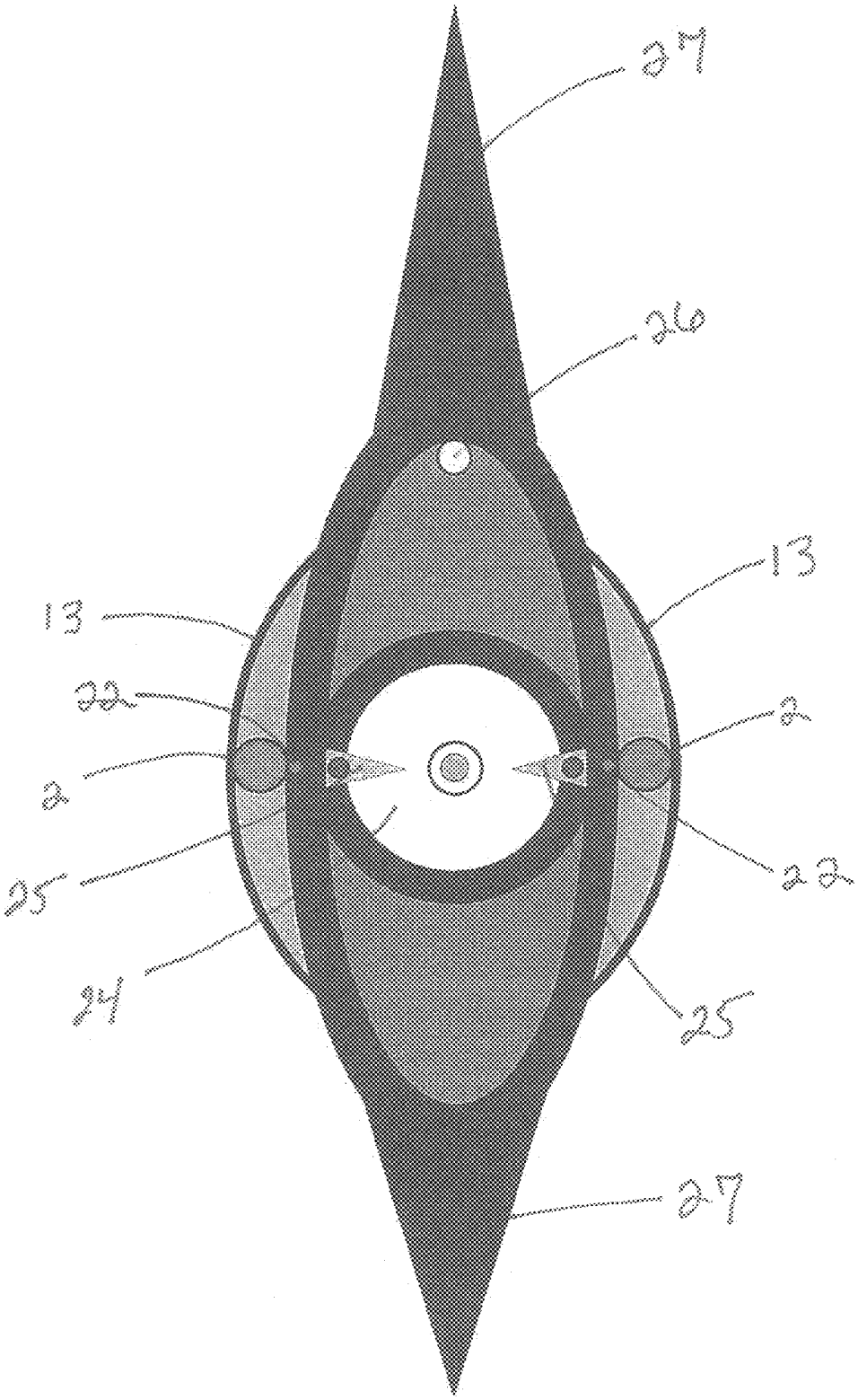
FIG. 11 is a top view of one embodiment of the tool of the present invention.

FIG. 11 depicts a top view of the ax handle head in the embodiment including the firearm component. The firearm components 13 are disposed on each side of the ax handle head, each with their own barrel 2 (a dual barrel configuration).

The flashlight 24, the shocking device prongs 25, the pepper spray vent 26, the ax's blades 27 and the laser beam opening 22 are also depicted in FIG. 11.

Figure 12:
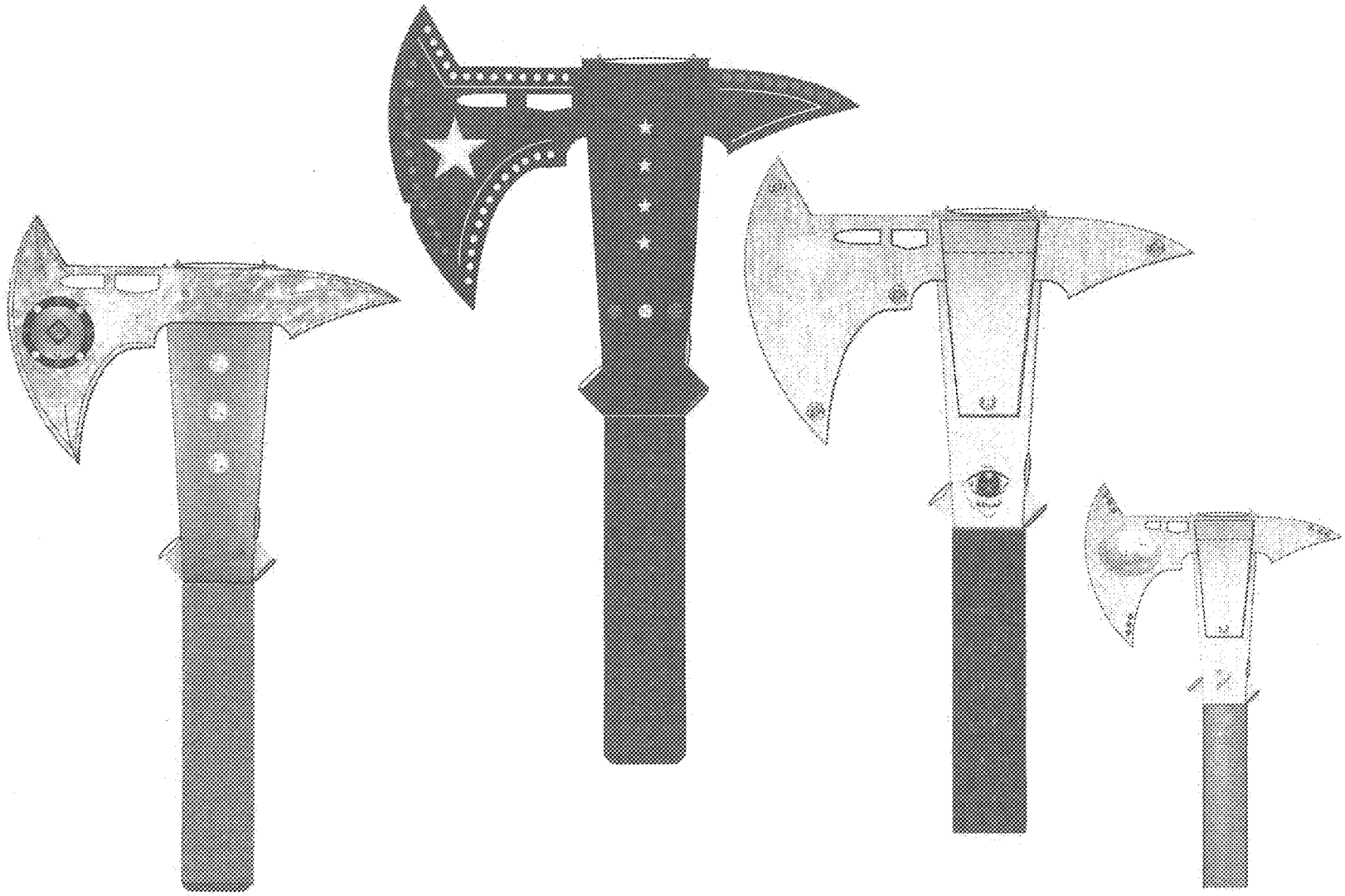
FIG. 12 illustrates various embellished ax heads of the tool of the present invention.

FIG. 12 illustrates the various ornamental designs for the ax tool of the present invention. The various metals used in the construction of the ax structure can comprise, for example: gold, titanium of varied colors, steel, brass, copper, platinum, silver, aluminum, and pewter; the jewels, for example, sapphires, rubies, emeralds, diamonds; and handle grip material types, such as various embossed leathers.

Figure 14:
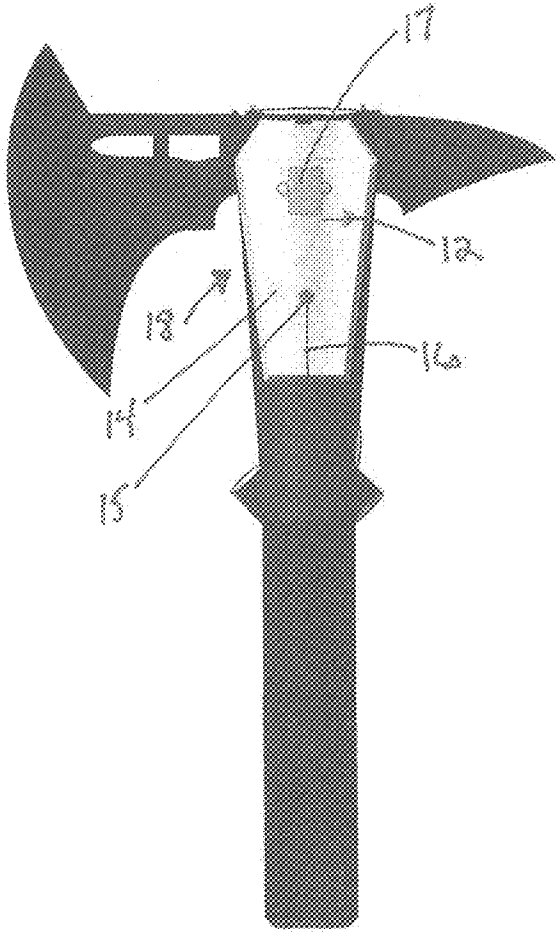
FIGS. 13 and 14 illustrate components associated with the firearm of the present invention.
Figure 13:
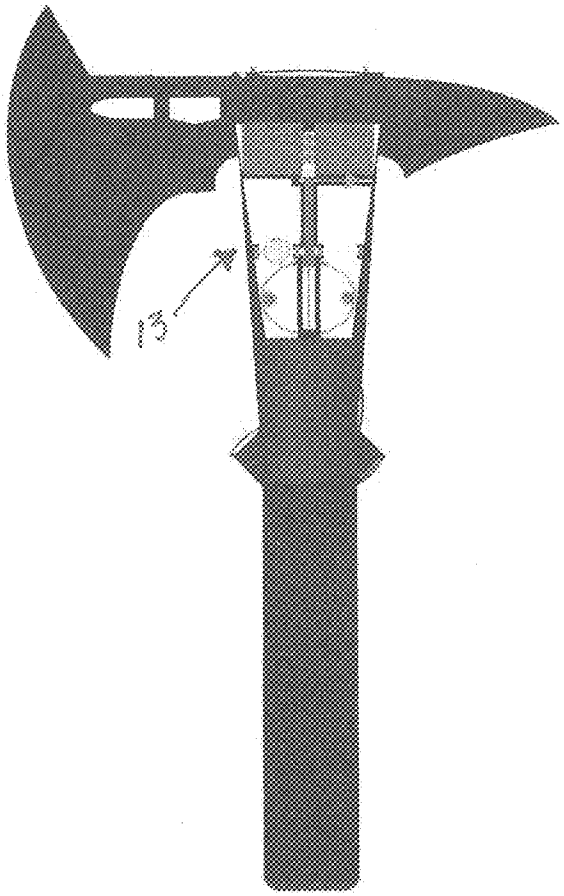

FIG. 13 depicts the ax structure, especially the firearm components, as described above, of the firearm component 13. A platform on which the operational components are disposed 18 is depicted in FIG. 14 showing the firing pin slider 15 and its respective groove 16, the primer safety handle 12, the trigger button 14 and the bullet loading zone cover 17. The bullet loading zone cover when removed or lifted opens up a compartment where the bullet is loaded into the barrel 2.

Figure 15:
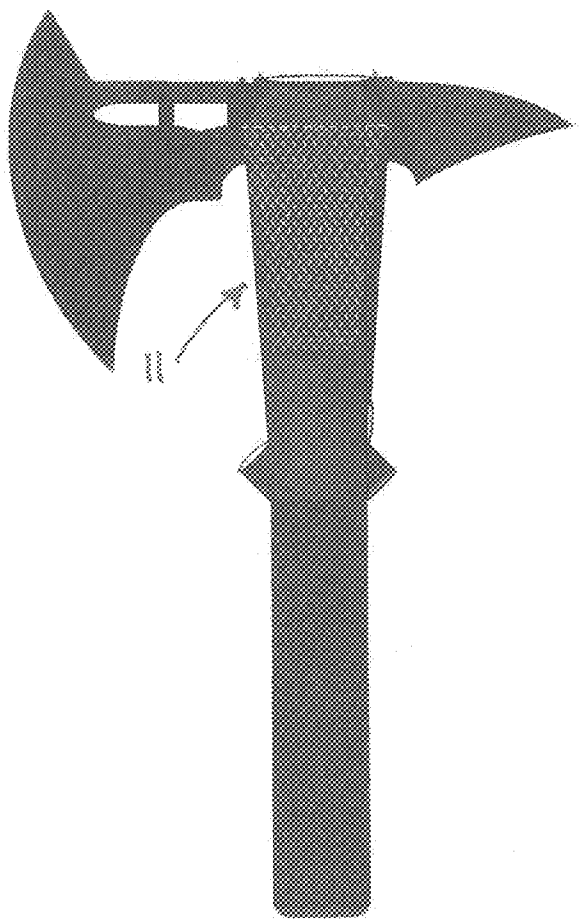
FIG. 15 illustrates a side view of the tool of the present invention.

FIG. 15 depicts the firearm component safety cover 11 in its closed position blocking the operational components of the firearm from view.

Figure 16:
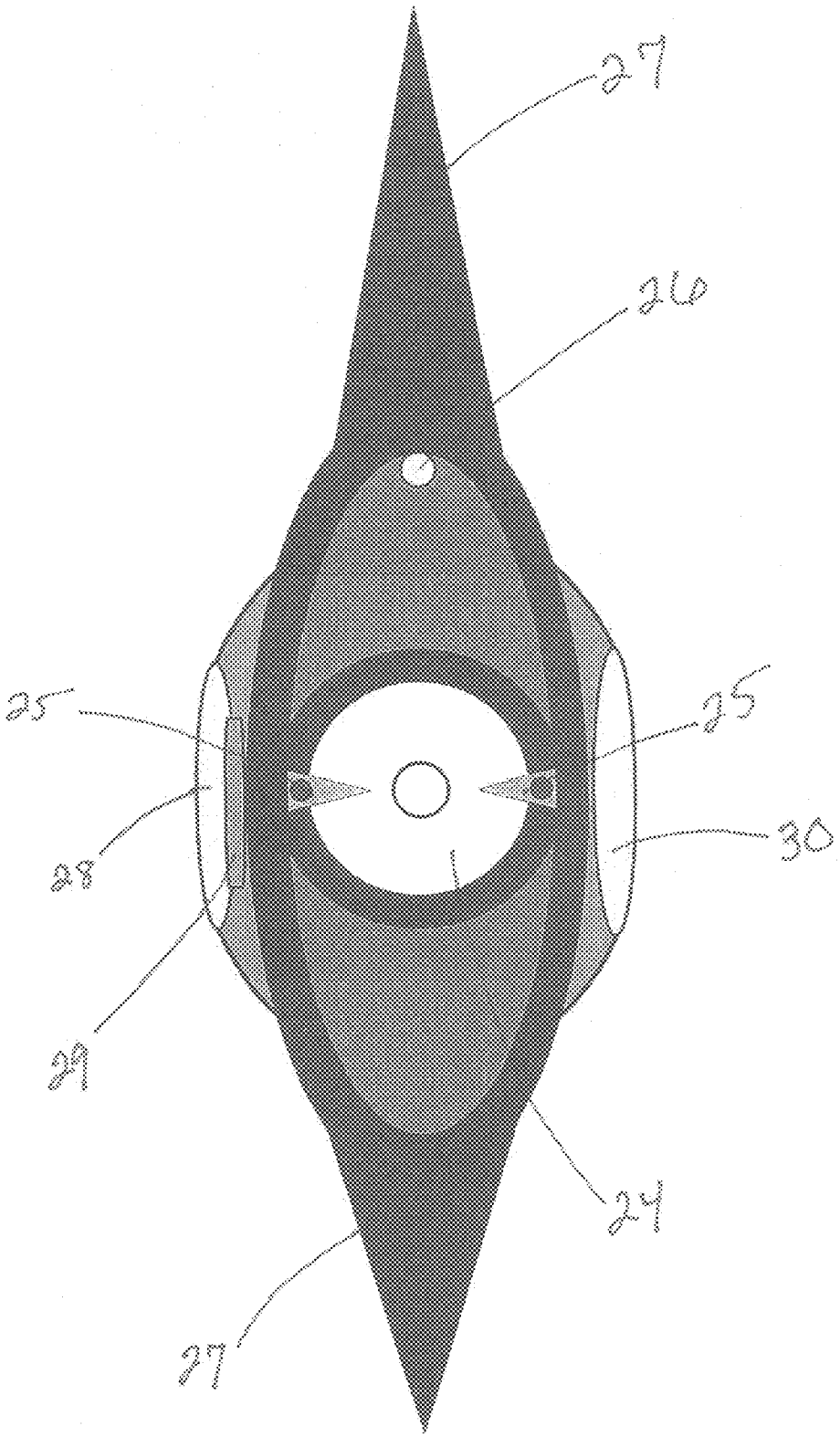
FIG. 16 is a top view and FIG. 17 an internal side view of one embodiment of the tool of the present invention.

FIG. 16 depicts the top view of another embodiment the ax handle tool. This embodiment includes the compass 28, the compass battery compartment 29, the flashlight 24, the shocking device prongs 25, the pepper spray vent 26, the ax blades 27 and the tool compartment 30. The compass 28 is always available for view on one side of the ax handle.

The tool compartment is covered by a safety cover 11, as depicted in FIG. 15. The tool compartment is designed to carry micro tools or a micro tool assembly of the user's choice.

Figure 17:
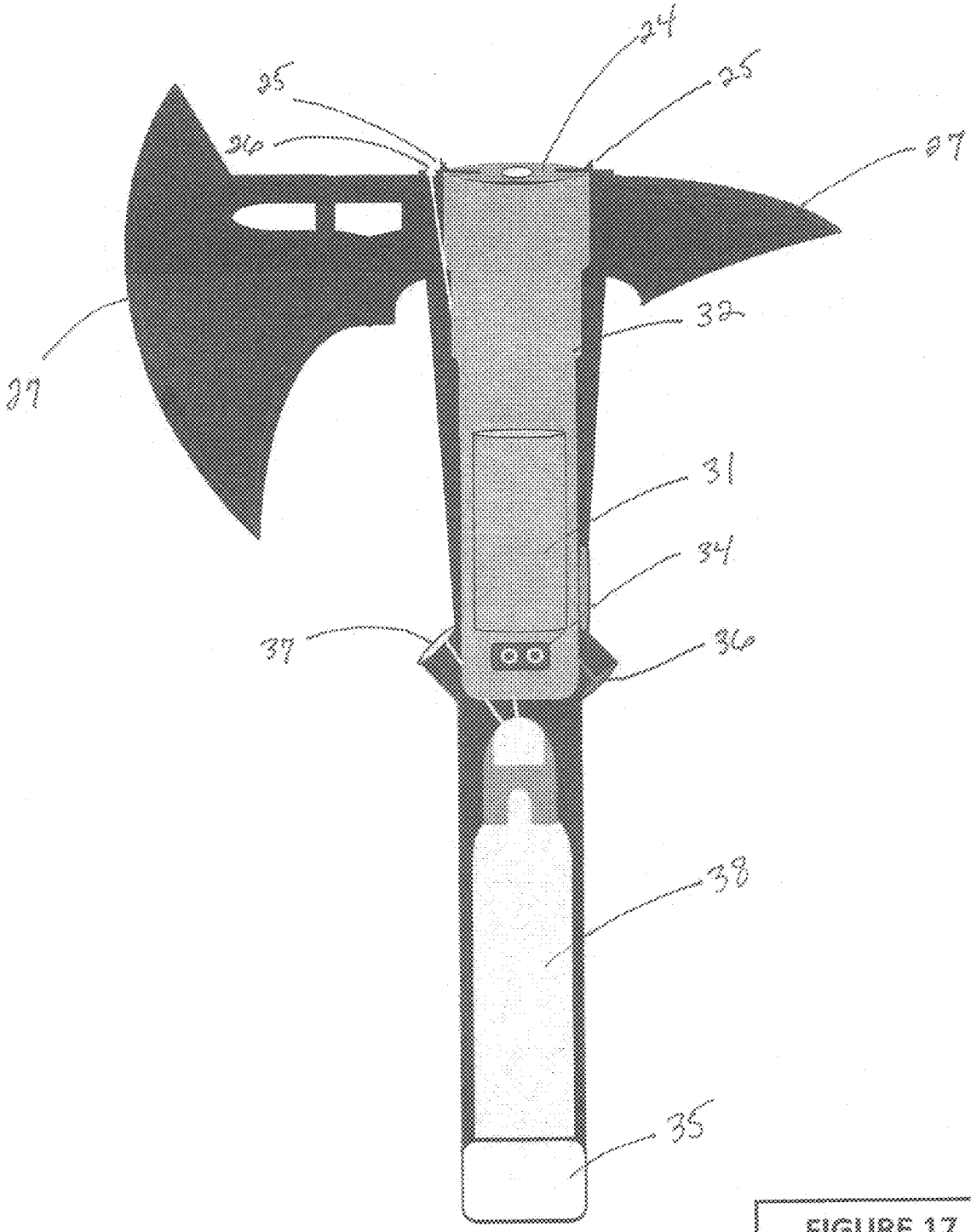
Figure 16B:
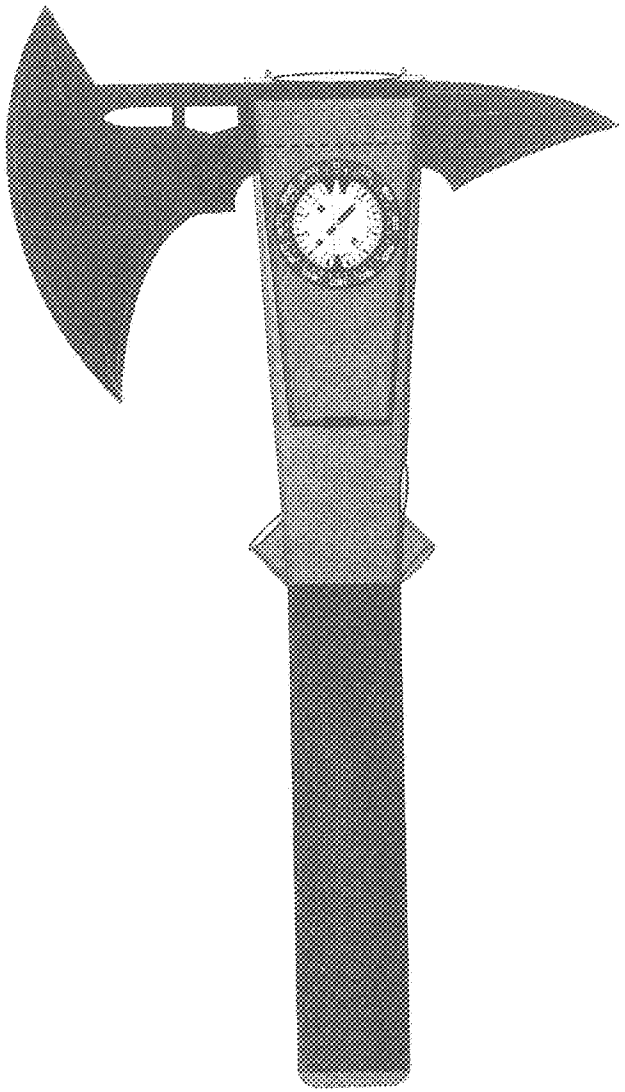
Figure 16A:
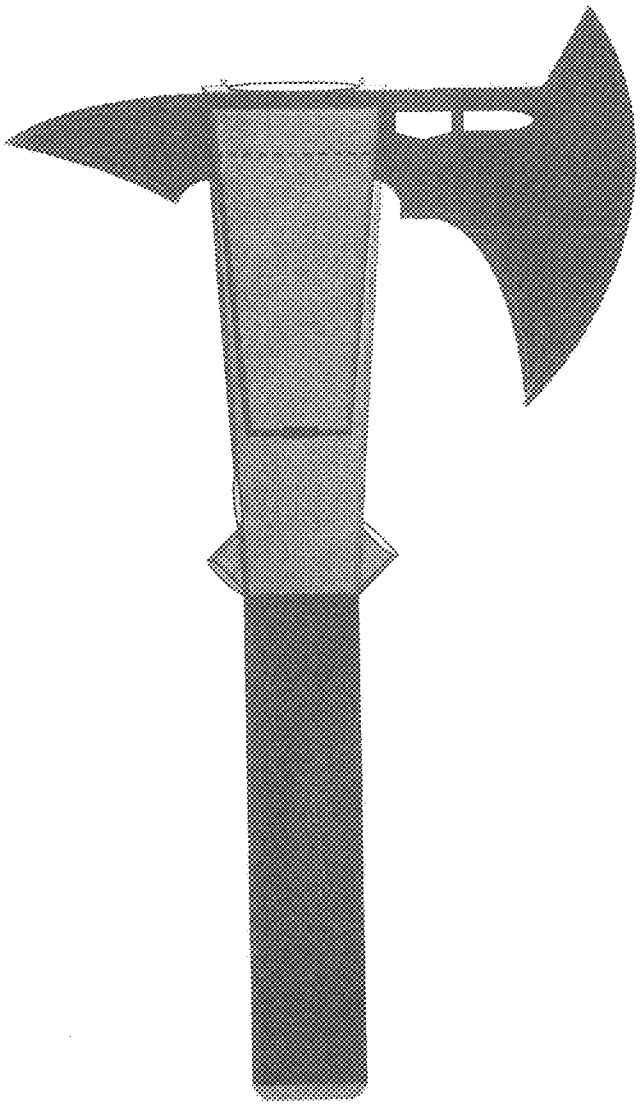
Figure 14B:
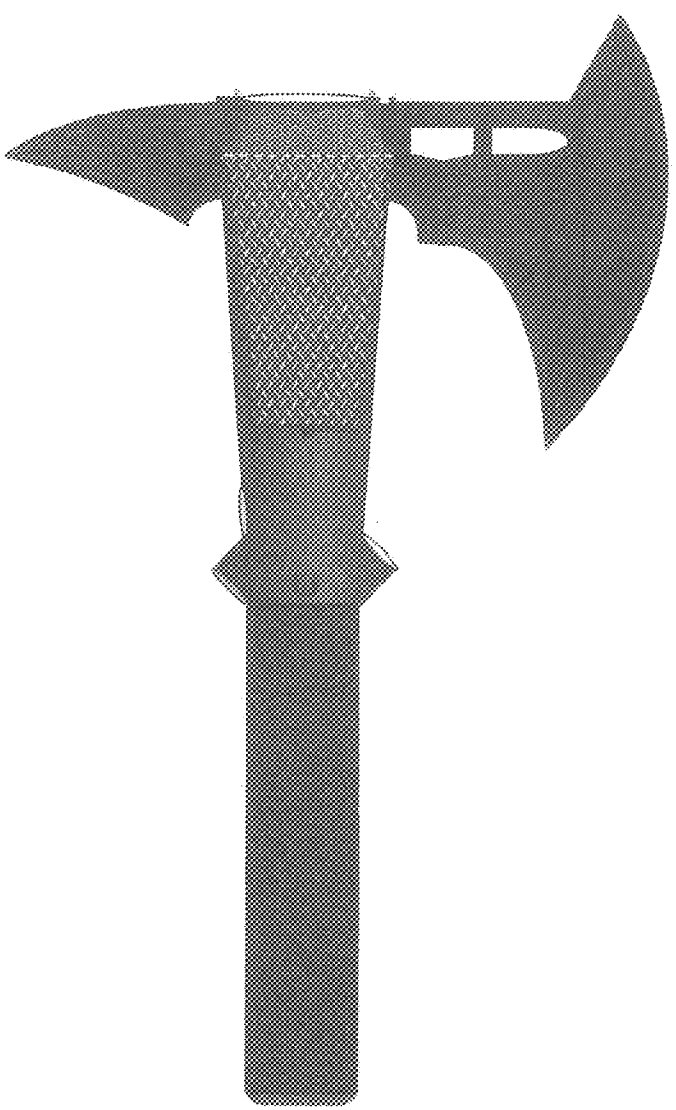
Figure 14A:
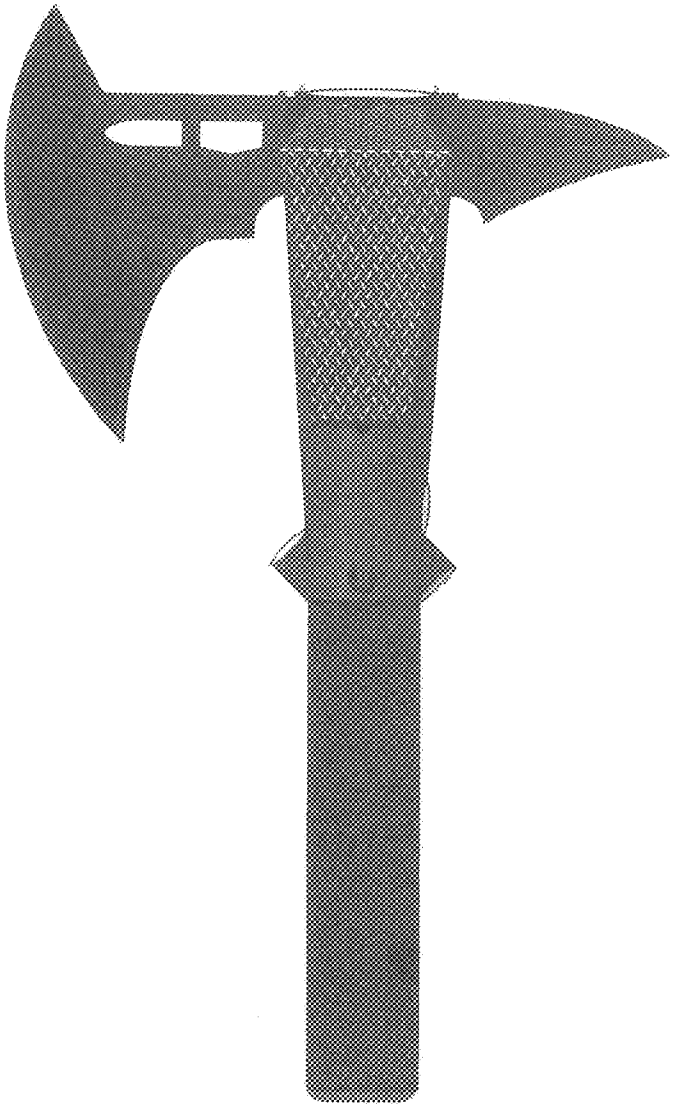

FIG. 17 depicts internal components of the ax structure as related to the shocking device component 32 and its associated components, i.e., a battery 31 for supplying power to the shocking device and a receptacle 34 for connection to a power source for charging the battery 31.

The pepper spray component 38 is illustrated within the ax handle. The button 37 activates the pepper spray component 38. The pepper spray exits through the pepper spray vent 26.

The hammer head 35 is attached after the tube of pepper spray 38 is installed. The hammer head can be used to hammer nails and/or to crush small aggregate.

FIGS. 18A and 18B depict two opposing sides of one embodiment of the ax tool. FIGS. 19A and 19B depict two opposing sides or another embodiment of the ax tool.

Although the invention has been shown and described with respect to a certain preferred embodiment or embodiments, equivalent alterations and modifications may occur to others skilled in the art upon the reading and understanding of this specification and the annexed drawings. In particular regard to the various functions performed by the above described components (assemblies, devices, circuits, etc.), the terms used to describe such components are intended to correspond, unless otherwise indicated, to any component that performs the specified function of the described component (i.e., that is functionally equivalent), even though not structurally equivalent to the disclosed structure, which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A tool comprising:

a firearm completely disposed within or on the tool, the firearm comprising:

a barrel through which a bullet passes to exit the firearm, a firing pin moveable to a firing position by operation of a firing pin control;

a firing pin lock retaining the firing pin in the firing position when in a locked position;

a first biasing member for applying a force to the firing pin, the firing pin restrained against the force by the locked position of the firing pin lock; and a trigger for releasing the firing pin lock from the locked position, the force causing the firing pin to strike a charge proximate a bullet, thereby causing the bullet to be exit the barrel;

an openable cover, when in an opened position revealing the firing pin control and the trigger each for operation by a user and when in a closed position concealing the firing pin control and the trigger;

a blade disposed on an external surface of the tool; and an ancillary device for performing a work task.

2. The tool of claim 1 further comprising an ax head and an ax handle, each of the firearm elements completely disposed within or on the ax head or the ax handle, the ancillary device further comprising a light, wherein a light beam emitted from the light extends from the ax head.

3. The tool of claim 2 further comprising a power source for the light, the power source disposed within an interior region of the ax handle or the ax head.

4. The tool of claim 1 further comprising an ax head and an ax handle, each of the firearm elements completely disposed within or on the ax head or the ax handle, the barrel disposed in the ax head such that the bullet exits the firearm from the ax head, and the trigger disposed on the ax handle.

5. The tool of claim 1 further comprising an ax head and an ax handle, each of the firearm elements completely disposed within or on the ax head or the ax handle, the ancillary device further comprising a shocking device, having shocking device prongs disposed at the ax head and a shocking device trigger disposed on the ax handle.

6. The tool of claim 1 further comprising an ax head and an ax handle, each of the firearm elements completely disposed within or on the ax head or the ax handle, the ancillary device further comprising a pepper spray instrument, a pepper spray instrument chamber disposed within an interior region of the ax handle and a pepper spray instrument trigger disposed on an exterior surface of the ax handle.

7. The tool of claim 1 further comprising an ax head and an ax handle, each of the firearm elements completely disposed within or on the ax head or the ax handle, the ancillary device further comprising a compass disposed on an exterior surface of the ax head or on an exterior surface of the ax handle.

8. The tool of claim 1 further comprising an ax head and an ax handle, each of the firearm elements completely disposed within or on the ax head or the ax handle, the tool further comprising a storage compartment defined within the ax head or within the ax handle.

9. The tool of claim 1 further comprising an ax head and an ax handle, each of the firearm elements completely disposed within or on the ax head or the ax handle, the blade disposed on the ax head.

10. The tool of claim 1 further comprising an ax head and an ax handle, each of the firearm elements completely disposed within or on the ax head or the ax handle, the ax handle having a flat surface for use as a hammer.

11. The tool of claim 1 the firearm further comprising a primer safety component a location of which relative to the charge is controlled by a primer safety handle, the primer safety component moveable to a firing position by operation of the primer safety handle.

12. The tool of claim 1 the firearm comprising a first firearm further comprising a first barrel, a first firing pin, a first firing pin lock, a first biasing member, and a first trigger, the tool further comprising a second firearm further comprising a second barrel, a second firing pin, a second firing pin lock, a second biasing member, and a second trigger.

13. The tool of claim 1 the firing pin control comprising a firing pin slider slidable within a groove of the tool.

14. The tool of claim 1 the first biasing member comprising a helical spring or a coil spring.

15. The tool of claim 1 further comprising a second biasing member, the first and second biasing members each applying a force to the firing pin.

16. A tool comprising:

a firearm completely disposed within or on the tool, the firearm comprising:

a barrel through which a bullet passes to exit the firearm, a firing pin moveable to a firing position by operation of a firing pin control;

a firing pin lock retaining the firing pin in the firing position when in a locked position;

a first biasing member for applying a force to the firing pin, the firing pin restrained against the force by the locked position of the firing pin lock; and a trigger for releasing the firing pin lock from the locked position, the force causing the firing pin to strike a charge proximate a bullet, thereby causing bullet to be exit the barrel;

a blade disposed on an external surface of the tool;

an ancillary device for performing a work task; and wherein the firing pin lock comprises a spring-driven component, in the locked position the spring-driven component contacting the firing pin and exerting a force on the firing pin to counter the force exerted by the first biasing member.

17. The tool of claim 16 further comprising an ax head and an ax handle, each of the firearm elements completely disposed in or on the ax head or the ax handle, the barrel disposed in the ax head such that the bullet exits the firearm from the ax head, the trigger disposed on the ax handle.

18. The tool of claim 16 further comprising an ax head and an ax handle, each of the firearm elements completely disposed in or on the ax head or the ax handle, the ancillary device further comprising a shocking device, having shocking device prongs disposed at the ax head and a shocking device trigger disposed on the ax handle.

19. The tool of claim 16 further comprising an ax head and an ax handle, each of the firearm elements completely disposed in or on the ax head or the ax handle, the ancillary device further comprising a pepper spray instrument, a pepper spray instrument chamber disposed within an interior of the ax handle and a pepper spray instrument trigger disposed on an exterior surface of the ax handle.

20. A tool comprising:

a firearm completely disposed within or on the tool, the firearm comprising:

a barrel through which a bullet passes to exit the firearm, a firing pin moveable to a firing position by operation of a firing pin control;

a firing pin lock retaining the firing pin in the firing position when in a locked position;

a first biasing member fir applying a force to the firing pin, the firing pin restrained against the force by the locked position of the firing pin lock; and a trigger for releasing the firing pin lock from the locked position, the force causing the firing pin to strike a charge proximate a bullet, thereby causing the bullet to be exit the barrel;

a blade disposed on an external surface of the tool;

an ancillary device for performing a work task; and a light for emitting a light beam in a direction of bullet travel.

* * * * *